US007581494B2

(12) United States Patent
Hochmüller et al.

(10) Patent No.: US 7,581,494 B2
(45) Date of Patent: Sep. 1, 2009

(54) CYLINDER FOR PROCESSING SHEETS OF PRINTING MATERIAL AND PRINTING PRESS HAVING THE CYLINDER

(75) Inventors: Uwe Hochmüller, St. Leon-Rot (DE); Michael Schwandt, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 220 days.

(21) Appl. No.: 11/603,614

(22) Filed: Nov. 22, 2006

(65) Prior Publication Data

US 2007/0113750 A1 May 24, 2007

(30) Foreign Application Priority Data

Nov. 23, 2005 (DE) ..... 10 2005 056 116

(51) Int. Cl.
*B41F 1/28* (2006.01)

(52) U.S. Cl. ..... 101/415.1; 101/382.1; 83/698.42

(58) Field of Classification Search ..... 101/382.1, 101/383, 384, 415.1; 83/331, 332, 659, 698.41, 83/698.42
See application file for complete search history.

(56) References Cited

U.S. PATENT DOCUMENTS 4,183,299 A * 1/1980 Cappel ..... 101/415.1
4,813,356 A * 3/1989 Abendroth et al. ..... 101/415.1
5,295,435 A * 3/1994 Fuchi ..... 101/415.1
5,295,436 A * 3/1994 Kittsteiner et al. ..... 101/415.1
5,503,073 A 4/1996 Bar
6,651,539 B1 11/2003 Eicher et al.
7,404,357 B2 * 7/2008 Knabe ..... 101/415.1

FOREIGN PATENT DOCUMENTS

DE 43 41 426 A1 6/1995
DE 198 14 966 A1 10/1999
DE 101 27 133 A1 12/2001
EP 1 348 550 A2 10/2003

* cited by examiner

*Primary Examiner*—Ren Yan
(74) *Attorney, Agent, or Firm*—Laurence A. Greenberg; Werner H. Stemer; Ralph E. Locher

(57) ABSTRACT

A cylinder for processing sheets of printing material includes a clamping channel having a central region and edge regions. A tool plate punches and/or scores and/or perforates the sheets. A support plate carries the tool plate. A first clamping system clamps the support plate and has a first holding device for holding a front end of the support plate and a second holding device for holding a rear end of the support plate. The first holding device and the second holding device are disposed in the edge regions. A second clamping system clamps the tool plate and has a third holding device for holding a front end of the tool plate and a fourth holding device for holding a rear end of the tool plate. The third holding device and the fourth holding device are disposed in the central region. A printing press having the cylinder, is also provided.

13 Claims, 3 Drawing Sheets

CYLINDER FOR PROCESSING SHEETS OF PRINTING MATERIAL AND PRINTING PRESS HAVING THE CYLINDER

CROSS-REFERENCE TO RELATED APPLICATION

This application claims the priority, under 35 U.S.C. §119, of German Patent Application DE 10 2005 056 116.0, filed Nov. 23, 2005; the prior application is herewith incorporated by reference in its entirety.

BACKGROUND OF THE INVENTION

1. Field of the Invention

The present invention relates to a cylinder for processing sheets of printing material. Such cylinders are used for punching and/or scoring and/or perforating the sheets. A printing press having the cylinder, is also provided.

German Patent DE 198 14 966 C2, corresponding to U.S. Pat. No. 6,651,539, describes a cylinder which includes a clamping channel, a tool plate for punching and/or scoring and/or perforating the sheets, a support plate for carrying the tool plate and a first clamping system for clamping the support plate. In the above-mentioned patent, the tool plate is referred to as a base sheet and the support plate is referred to a base plate. Furthermore, the cylinder includes a first holding device for holding a front end of the support plate, a second holding device for holding a rear end of the support plate, a third holding device for holding a front end of the tool plate and a fourth holding device for holding a rear end of the tool plate. The first holding device and the second holding device together form the first clamping system which is referred to as a blanket holding device in the above-mentioned patent. The third holding device and the fourth holding device are disposed on the support plate and are referred to as fastening bars in the above-mentioned patent.

It is a disadvantage of the cylinder of the prior art that the tool plate cannot be clamped onto it with accurate register. The fastening bars are comparatively unstable, which results from their configuration on the support plate and opposes improved register accuracy.

2. Summary of the Invention

It is accordingly an object of the invention to provide a cylinder for processing sheets of printing material on which a tool plate can be positioned with accurate register and a printing press having the cylinder, which overcome the hereinafore-mentioned disadvantages of the heretofore-known devices of this general type.

With the foregoing and other objects in view there is provided, in accordance with the invention, a cylinder for processing sheets of printing material. The cylinder comprises a clamping channel having a central region and edge regions. A tool plate punches and/or scores and/or perforates the sheets. A support plate carries the tool plate. A first clamping system for clamping the support plate has a first holding device for holding a front end of the support plate and a second holding device for holding a rear end of the support plate. The first holding device and the second holding device are disposed in the edge regions. A second clamping system for clamping the tool plate has a third holding device for holding a front end of the tool plate and a fourth holding device for holding a rear end of the tool plate. The third holding device and the fourth holding device are disposed in the central region.

The configuration of the third holding device and the fourth holding device in the central region makes it possible for the third holding device and the fourth holding device to be disposed separately from the support plate. This separate configuration makes a solid and stable configuration of the third holding device and the fourth holding device possible. The solid and stable configuration is in turn advantageous with regard to clamping the tool plate onto the cylinder with accurate register.

As a result of the fact that the third holding device and the fourth holding device together form the second clamping system, it is possible to clamp the tool plate in a manner which is independent of the clamping of the support plate, which in turn is advantageous with regard to the register accuracy. The tool plate can be not only held firmly through the use of the second clamping system, but can also be clamped, that is to say can be tautened in the circumferential direction of the cylinder.

In accordance with another feature of the invention, the first holding device and the second holding device are rotatably mounted clamping shafts.

In accordance with a further feature of the invention, the third holding device and the fourth holding device are clamping devices which include in each case a first clamping jaw and a second clamping jaw.

In accordance with an added feature of the invention, the clamping devices include in each case an eccentric shaft for adjusting the first clamping jaw toward and away from the second clamping jaw. The adjustment takes place during clamping and release of the tool plate.

In accordance with an additional feature of the invention, the second clamping system includes a gear mechanism for moving the fourth holding device toward and away from the third holding device. The movement takes place during release and clamping of the tool plate. This gear mechanism is preferably a worm gear mechanism.

In accordance with yet another feature of the invention, the second clamping system includes a joint for guiding the fourth holding device toward and away from the third holding device. The guidance takes place during release and clamping of the tool plate. This joint can be a rotary joint, about which the fourth holding device can pivot, and is preferably a linear thrust joint, that is to say a linear guide.

In accordance with yet a further feature of the invention, the third holding device is equipped with register pins for positioning of the tool plate with accurate register.

In accordance with yet an added feature of the invention, the cylinder has a basic body with a fastening head for fastening the second clamping system. The fastening head protrudes into the central region.

In accordance with yet an additional feature of the invention, the second clamping system has a carrier plate for carrying the third holding device and the fourth holding device. The carrier plate is fastened to the fastening head. The carrier plate is preferably fastened to the fastening head through the use of screws.

In accordance with still another feature of the invention, the fastening head is configured to be compatible with a covering hood for covering the central region. As a result, the second clamping system can optionally be fastened to the fastening head for a first cylinder equipment state, and the covering hood can be fastened to the fastening head for a second cylinder equipment state.

With the objects of the invention in view, there is also provided a printing press, comprising the cylinder configured according to the invention.

Other features which are considered as characteristic for the invention are set forth in the appended claims.

Although the invention is illustrated and described herein as embodied in a cylinder for processing sheets of printing material and a printing press having the cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
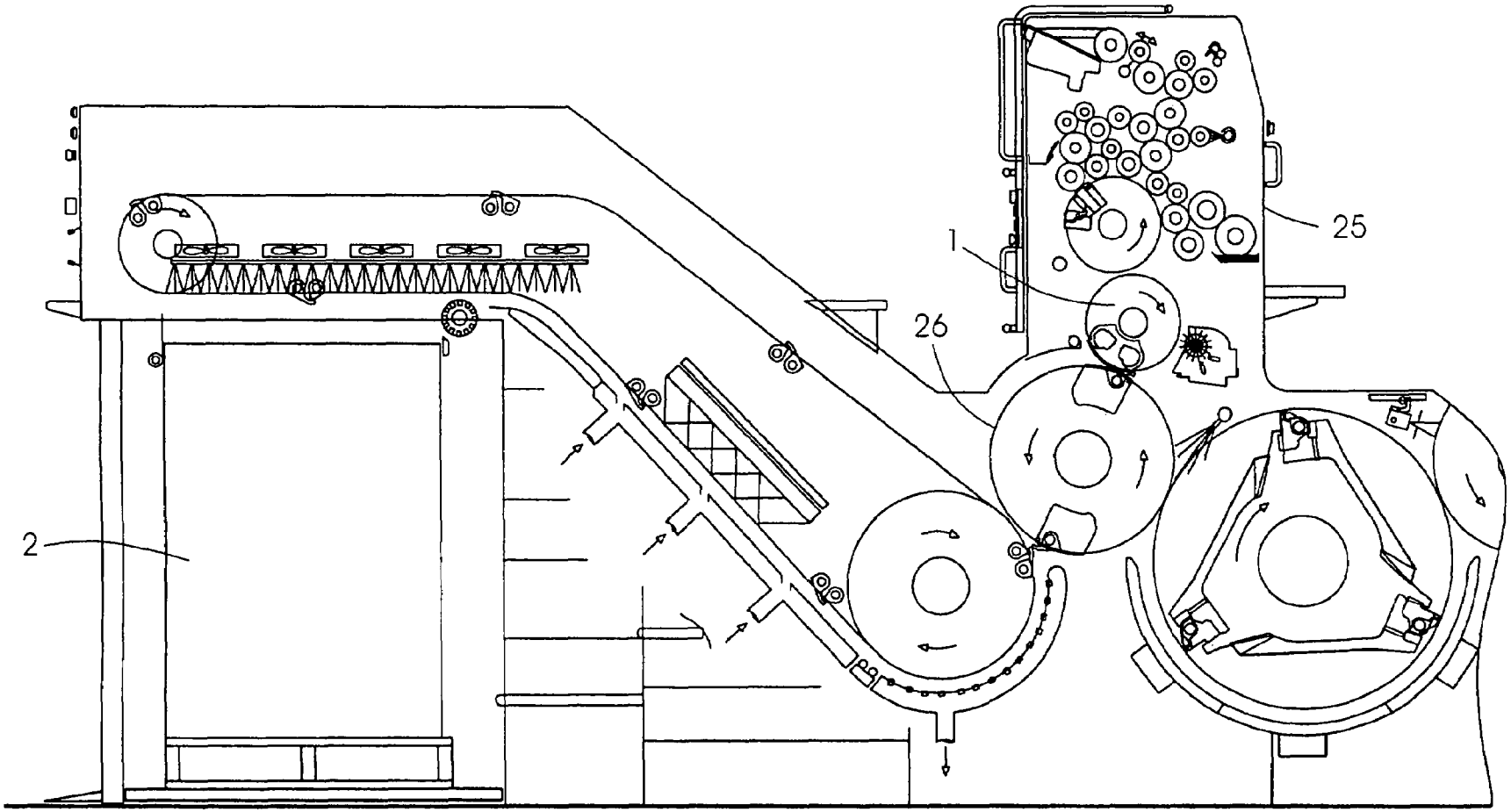
FIG. 1 is a diagrammatic, side-elevational view of a printing press having a cylinder.
Figure 2:
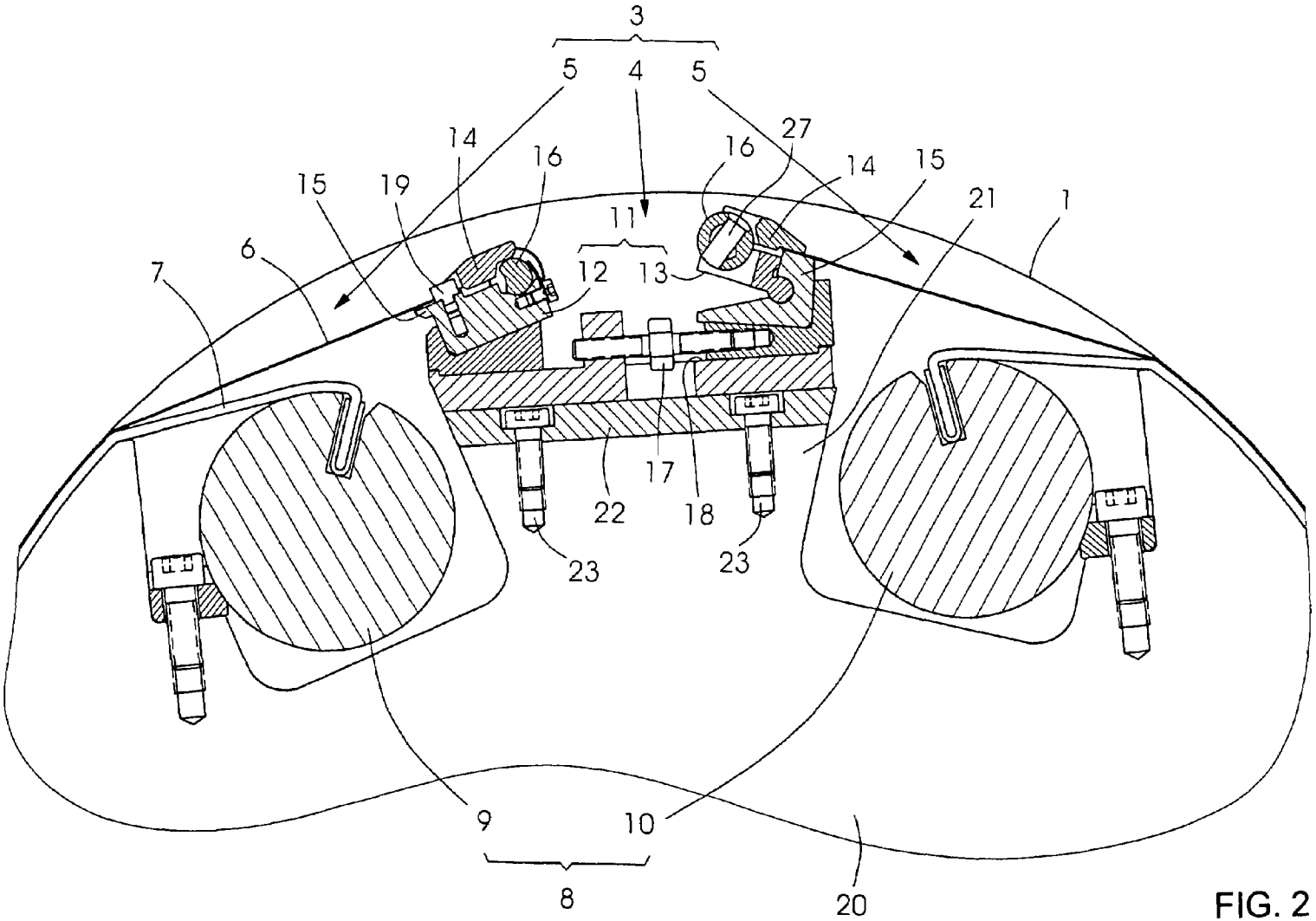
FIG. 2 is an enlarged, fragmentary, partly-sectional view of the cylinder of FIG. 1 in a first cylinder equipment state which is provided for punching and/or scoring and/or perforating, with a second clamping system being inserted into a clamping channel of the cylinder.

Referring now in detail to the figures of the drawings, in which elements and components that correspond to one another are identified by the same reference symbols and first, particularly, to FIG. 1 thereof, there is seen a printing press 25 having an impression cylinder 26 which interacts with a cylinder 1 for processing sheets 2 of printing material. After they are processed, the sheets 2 are deposited on a delivery stack which is shown in the drawing. FIG. 2 shows that the cylinder 1 has a clamping channel 3 which includes two edge regions 5 and one central region 4 which lies between these edge regions 5 as seen in the circumferential direction. A tool plate 6 which is provided with raised dividing tool lines for dividing the respective sheet 2 and/or deforming tool lines for deforming the sheet 2, is clamped on the cylinder 1. The dividing tool lines can, for example, be punching lines and/or perforating lines. The deforming tool lines can, for example, be scoring lines. The tool lines can be adhesively bonded onto the tool plate 6 and are not shown in the drawing for reasons of simplifying the drawing. The tool plate 6 is flexible and can be a metal sheet or a film. A flexible support plate 7 is clamped on the cylinder 1 below the tool plate 6.

The support plate 7 has a front end, which leads in the rotational direction of the cylinder 1, and is hooked into a first holding device 9. A rear end of the support plate 7, which trails in the rotational direction of the cylinder 1, is hooked into a second holding device 10. The first holding device 9 and the second holding device 10 together form a first clamping system 8 which serves to tauten the support plate 7 in the circumferential direction while it is being clamped to the cylinder 1. A second clamping system 11 serves to tauten the tool plate 6 in the circumferential direction while it is being clamped. The second clamping system 11 includes a third holding device 12 and a fourth holding device 13. A front end of the tool plate 6 is clamped into the third holding device 12 and a rear end of the tool plate 6 is clamped into the fourth holding device 13. The two ends of the tool plate 6 are not angled away in a hook-shaped manner, in contrast to the two ends of the support plate 7.

The cylinder 1 has a basic body 20, in which the clamping channel 3 is formed on the circumferential side. The basic body 20 includes a fastening head 21 which protrudes radially and is located in the central region 4. The fastening head 21 delimits two holes which are made in the basic body 20 and are situated in the edge regions 5. The first holding device 9 is disposed in one hole and the second holding device 10 is disposed in the other hole. The first holding device 9 and the second holding device 10 are clamping shafts which are rotated in opposite directions to one another in order to tauten the support plate 7.

The third holding device 12 and the fourth holding device 13 are not disposed on the support plate 7, but on the fastening head 21. As a consequence, a spacing which exists between the third holding device 12 and the fourth holding device 13 is smaller than a spacing which exists between the first holding device 9 and the second holding device 10. The third holding device 12 and the fourth holding device 13 are not only disposed more closely to one another than the first holding device 9 and the second holding device 10, but are also disposed to lie further radially outward than the first holding device 9 and the second holding device 10.

The third holding device 12 and the fourth holding device 13 each include a first clamping jaw 14 and a second clamping jaw 15, between which the respective end of the tool plate 6 is clamped. The third holding device 12 and the fourth holding device 13 are therefore configured as clamping devices. Each of these two clamping devices includes an eccentric shaft 16 which is disposed between the first clamping jaw 14 and the second clamping jaw 15. The eccentric shaft 16 of the third holding device 12 and the eccentric shaft 16 of the fourth holding device 13 are structurally identical to one another, but they appear to be different in FIG. 2 because the third holding device 12 and the fourth holding device 13 are shown in that figure in a manner which is sectioned in different sectional planes from one another. During clamping of the tool plate 6 between the first clamping jaw 14 and the second clamping jaw 15 of the respective clamping device, the first clamping jaw 14 is adjusted toward the second clamping jaw 15. The first clamping jaw 14 is adjusted away from the second clamping jaw 15 when the respective clamping device is opened again, in order to release the tool plate 6 from the respective clamping device. The eccentric shafts 16 are therefore rotated, in order to open and to close the clamping devices (third holding device 12, fourth holding device 13). Each eccentric shaft 16 has a socket wrench socket 27, as is shown in the drawing using the example of the eccentric shaft 16 of the fourth holding device 13. A socket wrench which forms a lever and has a handle is inserted into this socket wrench socket 27 which is configured as a transverse hole, for rotating the respective eccentric shaft 16.

In order to position the tool plate 6 on the cylinder 1 with accurate register, a register system is provided which includes register recesses and register pins 19 that engage into the register recesses. The register recesses are substantially U-shaped and are formed in the front edge of the tool plate 6. The register pins 19 are inserted into the second clamping jaw 15 of the third holding device 12. The number of register pins 19 is exactly the same as the number of register recesses, that is no more or less than two. One register pin 19 engages into one register recess and the other register pin 19 engages into the other register recess. In FIG. 2, only one of the two register pins 19 can be seen due to the sectional illustration which is selected for that figure. The rear edge of the tool plate 6 has no register recesses and the fourth holding device 13 has no register pins.

The fourth holding device 13 includes a clamping jaw carrier, in which the first clamping jaw 14 is mounted pivotably and which is mounted pivotably in the second clamping jaw 15. The clamping jaw carrier makes it possible for the first clamping jaw 14 to be adjusted very far away from the second clamping jaw 15, with the result that the rear end of the tool plate 6 can be introduced without problems between the first clamping jaw 14 and the second clamping jaw 15 of the fourth holding device 13, due to this large opening width of the fourth holding device 13. The third holding device 12 does not include a clamping jaw carrier of this type. The third holding device 12 and the fourth holding device 13 are therefore not completely structurally identical to one another. They differ from one another as a result of the presence of the register system only in the third holding device 12 and of the clamping jaw carrier of the fourth holding device 13.

Through the use of a gear mechanism 17, the fourth holding device 13 can be adjusted toward the third holding device 12 which in the process remains in its position which is stationary relative to the basic body 20, in order to tauten the tool plate 6, and can be adjusted in the opposite direction, in order to release the clamping of the tool plate 6. The gear mechanism 17 is a worm gear mechanism having a threaded spindle. A joint 18 is provided in order to guide the fourth holding device 13 during its adjustment which takes place relative to the third holding device 12. The joint 18 is a thrust joint, that is to say a linear guide, and guides the fourth holding device 13 in a secantal direction with regard to the cylinder 1. The threaded spindle of the gear mechanism 17 is also oriented in a direction of this type. A carrier plate 22 also belongs to the second clamping system 11. The third holding device 12 and the fourth holding device 13 are fastened to the carrier plate 22 by intermediate bars having an L-shaped profile. The carrier plate 22 can be screwed to the fastening head 21 through the use of screws 23.

Figure 3:
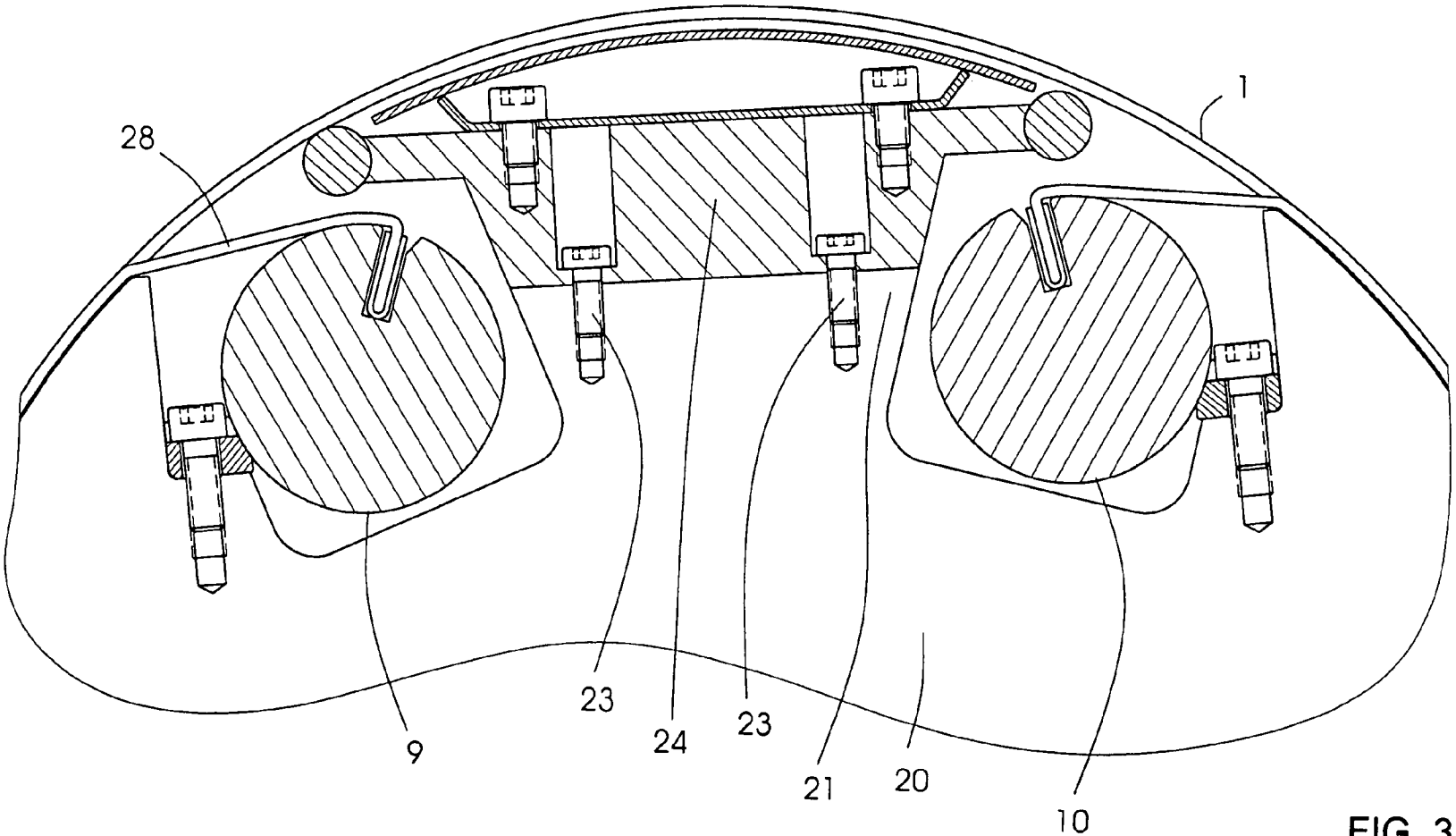
FIG. 3 is an enlarged, fragmentary, partly-sectional view of the cylinder of FIG. 1 in a second cylinder equipment state which is provided for printing or varnishing, with a covering hood being inserted into the clamping channel instead of the second clamping system of FIG. 2.

FIG. 3 shows the cylinder 1 in a cylinder equipment state which deviates from FIG. 2 and in which the tool plate 6 is omitted without replacement, the support plate 7 is replaced by a cylinder cover 28 and the second clamping system 11 is replaced by a covering hood 24 for covering the central region 4 of the clamping channel 3. The cylinder cover 28 is a rubber blanket for offset printing in the printing press 25, in which the offset printing takes place onto the sheets 2. The cylinder cover 28 could instead also be a varnishing blanket or a flexographic printing plate for varnishing the sheets 2 in the printing press 25. A front and a rear end of the cylinder cover 28 are held firmly by the first holding device 9 and the second holding device 10. The covering hood 24 includes a substantially bracket-shaped hollow profiled section which is composed of two bent metal sheets, and a carrier plate, to which the hollow profiled section is screwed. Instead of the carrier plate 22 (seen in FIG. 2) of the second clamping system 11, the carrier plate of the covering hood 24 is fastened to the fastening head 21 through the use of the screws 23. Holes which are formed in the fastening head 21 for the screws 23 correspond both to holes which are made in the carrier plate 22 of the second clamping system 11 for the screws 23 as well as to holes which are made in the carrier plate of the covering hood 24 for the screws 23.

The different cylinder equipment states result in a modular system, due to which the manufacturer of the printing press 25 can optionally equip the cylinder 1 in accordance with the specific requirements of different customers. For example, for a customer who wishes only to varnish or print the sheets 2 through the use of the cylinder 1, but does not wish to punch, score or perforate them, the cylinder 1 is installed in its cylinder equipment state shown in FIG. 3, into the printing press 25 which is delivered by the manufacturer to that customer.

If, however, another customer wishes to punch and/or score and/or perforate the sheets 2, the cylinder 1 is installed in its cylinder equipment state shown in FIG. 2, into the printing press 25 which is delivered by the manufacturer to the latter customer. However, that customer can also varnish or print the sheets 2 through the use of the cylinder shown in FIG. 2. To that end, the customer need only remove the tool plate 6 and the support plate 7 from the cylinder 1 and clamp a rubber blanket for offset printing or a flexographic printing plate or varnishing blanket for varnishing in place of the support plate 7. The customer can therefore perform both print jobs which require punching, scoring or perforating of the sheets 2 and print jobs which require varnishing or printing of the sheets 2 instead, through the use of the cylinder 1, with a low expenditure for changeover.

The second clamping system 11 is not used during varnishing or printing of the sheets 2 which takes place through the use of the cylinder 1, but it remains in its installation position in the cylinder 1.

We claim:

1. A cylinder for processing sheets of printing material, the cylinder comprising:

a clamping channel having a central region and edge regions;

a tool plate for punching and/or scoring and/or perforating the sheets;

a support plate for carrying said tool plate;

a first clamping system for clamping said support plate, said first clamping system having a first holding device for holding a front end of said support plate and a second holding device for holding a rear end of said support plate, said first holding device and said second holding device being disposed in said edge regions;

a second clamping system for clamping said tool plate, said second clamping system having a third holding device for holding a front end of said tool plate and a fourth holding device for holding a rear end of said tool plate, said third holding device and said fourth holding device being disposed in said central region;

a covering hood for covering said central region; and a basic body having a fastening head for fastening said second clamping system, said fastening head protruding into said central region and said fastening head being configured to be compatible with said covering hood, to permit said second clamping system to be fastened to said fastening head in a first cylinder equipment state, and to permit said covering hood to be fastened to said fastening head, replacing said second clamping system, in a second cylinder equipment state.

2. The cylinder according to claim 1, wherein said first holding device and said second holding device are rotatably mounted clamping shafts.

3. The cylinder according to claim 1, wherein said third holding device and said fourth holding device are disposed separately from said support plate.

4. The cylinder according to claim 1, wherein said third holding device and said fourth holding device are clamping devices each having a first clamping jaw and a second clamping jaw.

5. The cylinder according to claim 4, wherein said clamping devices each include an eccentric shaft for adjusting said first clamping jaw toward and away from said second clamping jaw during clamping and release of said tool plate.

6. The cylinder according to claim 1, wherein said second clamping system includes a gear mechanism for moving said fourth holding device toward and away from said third holding device during release and clamping of said tool plate.

7. The cylinder according to claim 6, wherein said gear mechanism is a worm gear mechanism.

8. The cylinder according to claim 1, wherein said second clamping system includes a joint for guiding said fourth holding device toward and away from said third holding device during release and clamping of said tool plate.

9. The cylinder according to claim 8, wherein said joint is a linear thrust joint.

10. The cylinder according to claim 1, wherein said third holding device is equipped with register pins for positioning said tool plate with accurate register.

11. The cylinder according to claim 1, wherein said second clamping system has a carrier plate for carrying said third holding device and said fourth holding device, said carrier plate being fastened to said fastening head.

12. The cylinder according to claim 11, wherein said carrier plate is fastened to said fastening head by screws.

13. A printing press, comprising the cylinder according to claim 1.

* * * * *